United States Patent [19]

Siegel

[11] 3,981,028

[45] Sept. 21, 1976

[54] POCKET DEVICE

[75] Inventor: Joseph Siegel, Port Washington, N.Y.

[73] Assignee: The Raymond Lee Organization, Inc., New York, N.Y. ; a part interest

[22] Filed: June 9, 1975

[21] Appl. No.: 584,702

[52] U.S. Cl. ..... 2/254

[51] Int. Cl.[2] ..... A41D 27/20

[58] Field of Search ..... 2/250, 254, 247–249, 2/251–253

[56] References Cited

UNITED STATES PATENTS

| | | | |
|---|---|---|---|
| 851,966 | 4/1907 | Shaw | 2/254 |
| 1,496,330 | 6/1924 | Tollefson | 2/250 |
| 1,821,809 | 9/1931 | Johnson | 2/254 |
| 1,821,837 | 9/1931 | Johnson | 2/254 |
| 1,900,639 | 3/1933 | Foster | 2/254 |
| 2,899,684 | 8/1959 | Riley | 2/254 |

*Primary Examiner*—G. V. Larkin

*Attorney, Agent, or Firm*—Daniel Jay Tick

[57] ABSTRACT

An inner pocket is affixed to an outer pocket of an item in inverted position. The inner pocket has an open bottom spaced from and in close proximity with the bottom of the outer pocket. The inner pocket has a closed top in the outer area of the top of the outer pocket. Thus, an article is passable alongside the inner pocket in the pocket and into the inner pocket via the open bottom of the inner pocket and is inaccessible to casual removal from the outer pocket.

3 Claims, 4 Drawing Figures

POCKET DEVICE

DESCRIPTION OF THE INVENTION

The present invention relates to a pocket device. More particularly, the invention relates to a pocket device for the pocket of an item such as an article of clothing, a handbag, or the like.

Objects of the invention are to provide a pocket device of simple structure, which is inexpensive in manufacture, installed with facility and convenience, used with facility and convenience, and functions efficiently, effectively and reliably to secure an article such as, for example, a wallet, or other valuable article, for casual removal thereby preventing stealing of the article by a pickpocket, or the like.

In order that the invention may be readily carried into effect, it will now be described with reference to the accompanying drawing, wherein.

Figures 1, 2, 3, 4:
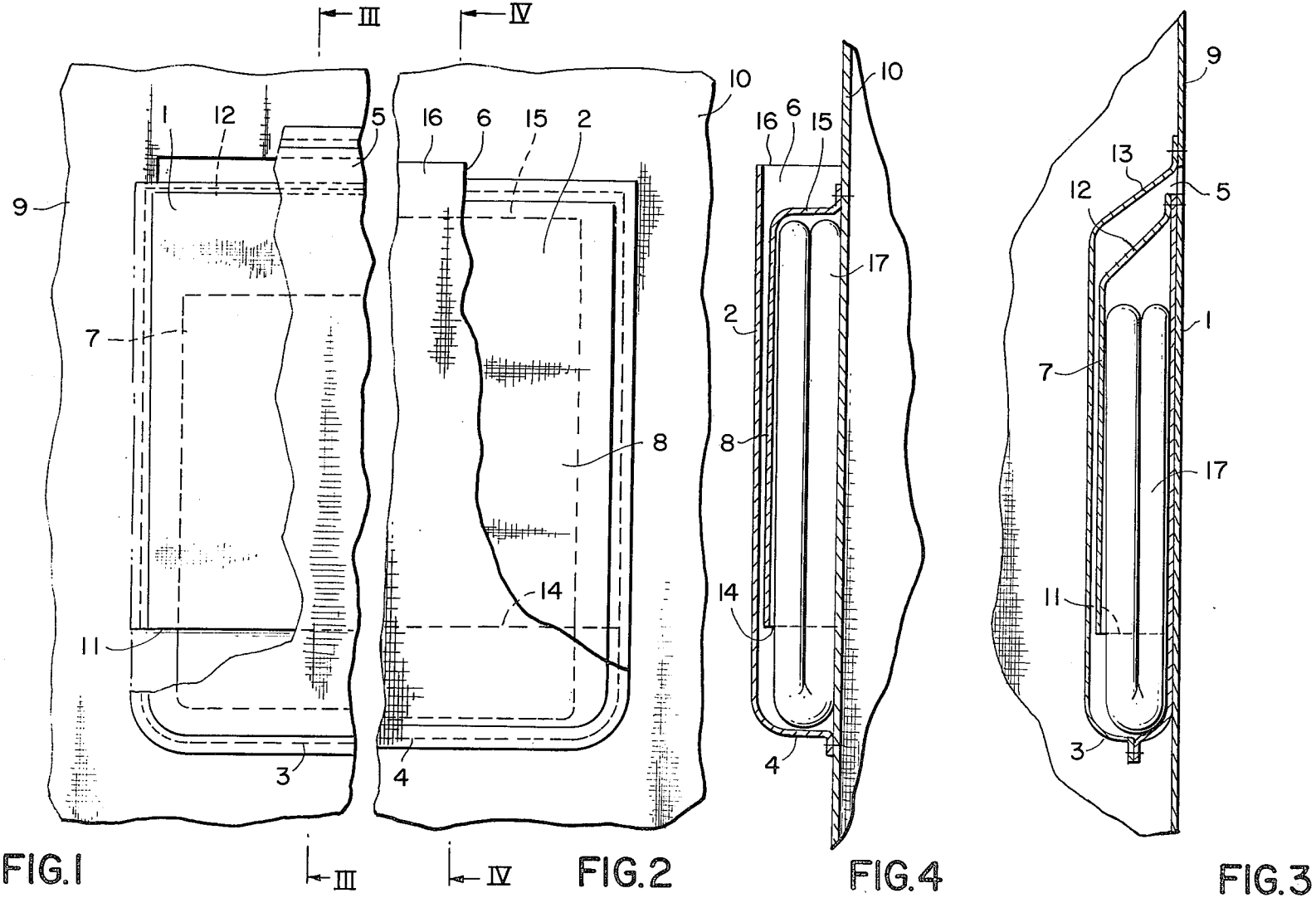
FIG. 1 is a plan view, partly cutaway, of an embodiment of the pocket device of the invention affixed in an inside pocket of an item.
FIG. 2 is a plan view, partly cutaway, of another embodiment of the inside pocket of the invention affixed in a patch pocket.
FIG. 3 is a cross-sectional view, taken along the line III—III, of FIG. 1.
FIG. 4 is a cross-sectional view, taken along the line IV—IV of FIG. 2.

The pocket device of the invention is for the outer pocket 1 (FIG. 1), 2 (FIG. 2), or the like, of an item such as, for example, an article of clothing, a handbag, a suitcase, or the like. The outer pocket may be an inside pocket, as shown in FIGS. 1 and 3, or an outside or patch pocket 2, as shown in FIGS. 2 and 4, or any other type of pocket. The outer pocket has a closed bottom 3 (FIGS. 1 and 3) or 4 (FIGS. 2 and 4) and an open top 5 (FIGS. 1 and 3) or 6 (FIGS. 2 and 4).

The inner pocket 7 (FIGS. 1 and 3) or 8 (FIGS. 2 and 4) is affixed to an item 9 (FIG. 1 and 3) or 10 (FIGS. 2 and 4) such as, for example, an article of clothing, in the outer pocket 1 or 2, respectively, in inverted position, or to the outer pocket itself, as shown in the FIGS. "Affixed" is intended to means "secured" by any suitable means such as, for example, by thread, stitched with a needle. The inner pocket 7 has an open bottom 11 spaced from, and in close proximity with, the bottom 3 of the pocket outer 1 and a closed top 12 in the area of the top 13 of the outer pocket 1. The inner pocket 8 has an open bottom 14 spaced from, and in close proximity with, the bottom 4 of the outer pocket 2 and a closed top 15 in the area of the top 16 of the outer pocket 2 (FIGS. 2 and 4). Thus, an article 17 such as, for example, a wallet or other valuable, is passable alongside the inner pocket 7 or 8 in the outer pocket 1 or 2, respectively, and into the inner pocket via the open bottom of the inner pocket. The article 17 is inaccessible to casual removal from the outer pocket 1 or 2.

The inner pocket 7 or 8 comprises flexible material which permits manipulation of an article into and out of the inner pocket.

While the invention has been described by means of specific examples and in specific embodiments, I do not widh to be limited thereto, for obvious modifications will occur to those skilled in the art without departing from the spirit and scope of the invention.

I claim:

1. A pocket device for an item, said pocket device comprising an outer pocket of the item having a closed bottom and an open top;

an inner pocket affixed in the outer pocket in inverted position, said inner pocket having an open bottom spaced from and in close proximity with the bottom of the outer pocket and a closed top in the area of the top of the outer pocket whereby an article is passable alongside the inner pocket in the outer pocket and into the inner pocket via the open bottom of said inner pocket and is inaccessible to casual removal from the outer pocket.

2. A pocket device as claimed as in claim 1, wherein the inner pocket comprises flexible material which permits manipulation of an article into and out of the inner pocket.

3. A pocket device as claimed in claim 1, wherein the inner pocket retains an article therein by gravity when the outer pocket is rotated 180°.

* * * * *